US008596639B1

(12) United States Patent
Hinson

(10) Patent No.: US 8,596,639 B1
(45) Date of Patent: Dec. 3, 2013

(54) LUCKY DOG MILLION DOLLAR BOX PATTERN BUSTER

(75) Inventor: Danny Lee Hinson, Youngsville, NC (US)

(73) Assignee: Danny Lee Hinson, Youngsville, NC (US)

( * ) Notice: Subject to any disclaimer, the term of this patent is extended or adjusted under 35 U.S.C. 154(b) by 126 days.

(21) Appl. No.: 12/799,514

(22) Filed: Apr. 27, 2010

Related U.S. Application Data

(63) Continuation of application No. 12/657,829, filed on Jan. 28, 2010, now abandoned.

(60) Provisional application No. 61/206,267, filed on Jan. 30, 2009.

(51) Int. Cl.
*A63F 3/06* (2006.01)
*A63F 7/04* (2006.01)

(52) U.S. Cl.
USPC ..... 273/144 B; 273/144 A; 273/144 R

(58) Field of Classification Search
USPC ..... 273/144 B, 144 A, 144 R
See application file for complete search history.

(56) References Cited

U.S. PATENT DOCUMENTS

| | | | | | |
|---|---|---|---|---|---|
| 4,403,775 | A | * | 9/1983 | Chaput | 273/144 B |
| 4,444,394 | A | * | 4/1984 | Pasquine | 273/144 B |
| 4,545,578 | A | * | 10/1985 | Stagg, Jr. | 273/144 B |
| 4,807,881 | A | * | 2/1989 | Jaquez | 273/144 B |
| 4,884,810 | A | * | 12/1989 | Tiyony | 273/144 B |
| 5,507,492 | A | * | 4/1996 | Adell | 273/144 B |
| 5,794,980 | A | * | 8/1998 | Bigler | 281/2 |
| 6,012,716 | A | * | 1/2000 | Adell | 273/144 B |

* cited by examiner

*Primary Examiner* — Benjamin Layno

(57) ABSTRACT

This is a rectangular box for randomly picking lottery numbers. The box is comprised of a rectangular shaped frame that holds a permanent place for a thin number pattern card with numbers on front and back of card. Unlike other related art in the invention the number card has a rectangular screen with open rectangular squares to be applied to lie over the front and back of number card. This will allow balls or objects to be trapped in a square on the number card. When the balls or objects are scattered about then laid still it will reveal the number on the card trapped by the screen. A thin Plexiglas cover is applied over the front and back of the screen, number card, frame, and brass balls to protect and keep the brass balls or objects from falling out of the box when shook.

2 Claims, 1 Drawing Sheet

LUCKY DOG MILLION DOLLAR BOX PATTERN BUSTER

CROSS-REFERENCE TO RELATED APPLICATIONS

| | | | |
|---|---|---|---|
| U.S. Pat. No. 4,444,394 | April 1984 | Pasquinade, Anthony | 273/144B |
| U.S. Pat. No. 4,807,881 | February 1989 | Jacques, Ramiro | 273/144B |
| U.S. Pat. No. 5,507,492 | April 1996 | Adel, Robert | 273/144B |
| U.S. Pat. No. 5,794,980 | August 1998 | Bugler, Karen Robbins | 281/2 |
| U.S. Pat. No. 6,012,716 | January 2000 | Adel, Robert | 273/144B |

STATEMENT REGARDING FEDERALLY SPONSORED RESEARCH OR DEVELOPMENT

"Not Applicable"

THE NAMES OF THE PARTIES TO A JOINT RESEARCH AGREEMENT

"Not Applicable

INCORPORATION-BY-REFERENCE OF MATERIAL SUBMITTED ON A COMPACT DISC

"Not applicable

BACKGROUND OF THE INVENTION (1) Field of the Invention

This invention relates to a compact box structure holding brass ball or objects etc for randomly picking numbers for lottery game pattern cards. My invention has modified the prior invention by the Art, making internal parts and components in arrangements for a smother and free flow of balls or objects to land on random numbers within the box. This gives the public a better opportunity to get the most out of a random number selector. The Lucky Dog Million Dollar Box Pattern Buster performs this task.

(2) Description of the Prior Art

The prior art relating to this invention is believed to reside in Class 273, Sub-classes 144 and 148. Patentability search has indicated the existence of the following U.S. Pat. Nos. 3,237,949, 4,497,486, 4,545,578, and 4,498,671. Referring to all four patents, they all have similar features even such as rectangular square, sides, tops, bottoms, screens, numbers, balls, transparent covers, etc. All is an old concept in the art. The structures pointed out in these patents have the same concept but they are all structurally different. Therefore, The Lucky Dog Million Dollar Box Pattern Buster has merit in the fact that it performs similar, but believed better in the fact that it does not have recessed number card which limits the flow and movement of the balls to move freely over the number card. It seems they would fall in a routine pattern. Another objective to the invention is that The Lucky Dog Box's rectangular screen is a thin sheer wire screen that allows the brass balls to easily bump over the wire. This would make the invention a more random selector. A further objective is that the number card numbers are arranged like the current lottery game pattern card numbers. In other words the invention number pattern card would not have to have numbers. The user would simply match the box pattern with the lottery game card pattern which makes the use of the numbers on the number card irrelevant. This eliminates the need to read small numbers. One would simply match pattern to pattern. Another objective to the invention is by using brass balls they are heavy weight and perform better when bumping over the wire screen giving it a more gaming sound effect.

BRIEF SUMMARY OF THE INVENTION

The invention is a compact hollow rectangular box used to hold small brass balls or other similar objects. The balls are to be used to roll around in the inner rectangular part of the box. There shall be a pattern card with numbers on it with a rectangular shaped screen with open squares to trap the balls within the numbered slots. This identifies numbers in that space pattern or just the space on the pattern card to be used to identify a numbered area on a real lottery pattern card. This is to be used in a lottery game of chance. Each rectangular box shall have Plexiglas or clear cover over the number pattern card and a screen to keep the balls from falling out of the box. Another characteristic of The Lucky Dog Million Dollar Box Pattern Buster is that it could provide unlimited access or exposure for promotional advertisement.

(1A) views a glow ball purpose for amusement (1B) is a view of top frame bar purpose is to claim top end of number pattern card and inner rectangular box (1C) a view of the number pattern card (1D) a view of the front thin rectangular wire screen purpose is to lie over the pattern number card to trap a ball in a rectangular square over a number (1E) a view of a brass ball trapped in the rectangular square over the pattern number card (1F) a view of the front left side post purpose is to claim left side of pattern number card (1G) is a view of the front right side post purpose is to claim right side of pattern number card (1H) is a view of front spacer bar purpose is to eliminate or block out number not needed to match pattern number card (1I) is a view of the front bottom frame bar purpose is to claim front bottom pattern number card

FIG. 2

Figure 3:
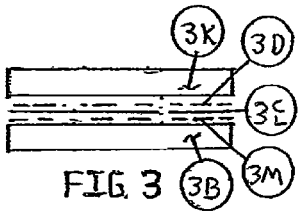

(2J) is a view of the five brass balls purpose is to fall in a rectangular square on pattern number card (2K) is a view of the back top frame bar purpose is to claim the back top of the pattern card (2L) is a view of the back of the pattern number card (2M) is a view of the back thin rectangular wire screen purpose is to lie over the pattern number card to trap a ball in a rectangular square over a number (2N) is a view of the left back side post purpose is to claim left side of pattern number card (2O) is a view of the right back side post purpose is to claim back right of number pattern card (2P) is a view of the back spacer bar purpose is to eliminate or block out numbers not needed to match number pattern card (2Q) is a view of the back bottom frame bar purpose is to claim back bottom of pattern number card FIG. 3 is a top view of the frame bars, thin wire screens and front and back of pattern card.

Figure 4:
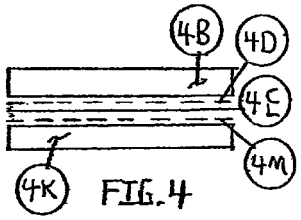

FIG. 4 is bottom view of the frame bars, thin wire screens and front and back of pattern card.

FIG. 5

(5R) is a view of the left side cover of the rectangular box.

Figure 6:
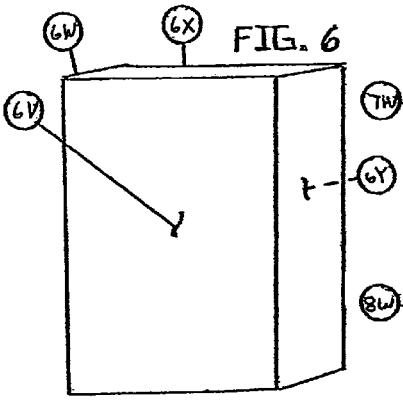
Figure 7:
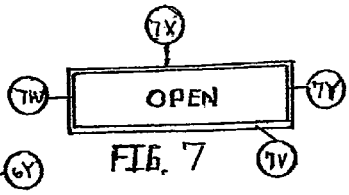
Figure 8:
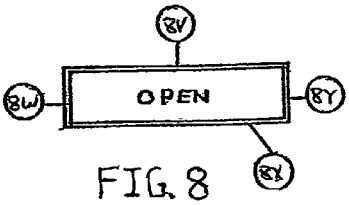
Figure 9:
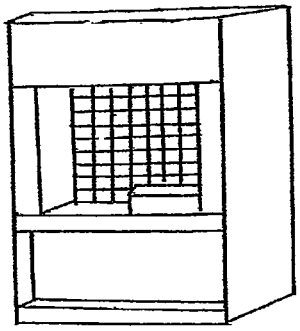

(5S) is a view of back Plexiglas cover purpose is to protect and keep the brass balls from falling out (5T) is a view of front Plexiglas cover purpose is to protect and keep the brass balls from falling out (5U) is a view of the right side cover of the rectangular box FIG. 6 is a view of the rectangular box protective cover (6V) is a view of the front of the rectangular protective box cover (6W) is a view of the left side of the rectangular box cover (6X) is a view of the back of the rectangular box cover (6Y) is a view of the right side of the rectangular protective box cover FIG. 7 is a view of the top of the rectangular protective box cover FIG. 8 is a view of the bottom of the rectangular protective box cover FIG. 9 is a view of the rectangular pattern box

DETAILED DESCRIPTION OF THE INVENTION

Figure 1:
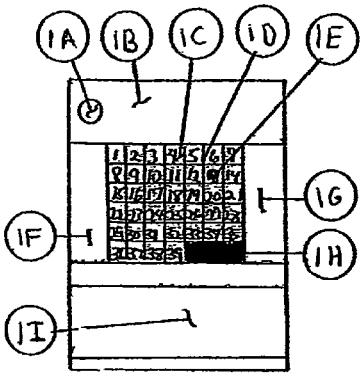
FIG. 1. Is a flat view of the random pattern card buster. It also displays the number card and other structure parts of its function such as (A) describes a glow ball for amusement.
Figure 5:
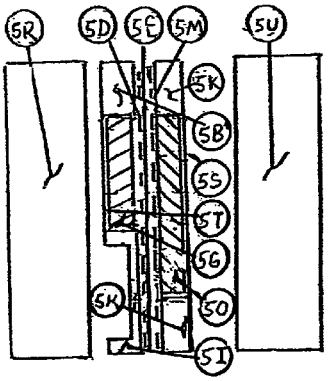

With reference to the drawing wherein like numerals designate likes and corresponding parts throughout the several views in FIG. 1 to FIG. 9. FIG. 1 through FIG. 1 includes a box illustrated for housing or to store brass balls and a pattern number card for randomly picking lottery numbers using a box style shape. FIG. 1 is generally comprised of an inner rectangular shaped box for storing the numbered pattern card, card screen, spacer bar, and brass balls. FIG. 5 show 5T & 5S a transparent cover to cover the front and back of FIG. 2 the inner rectangular box to keep the brass balls from falling out of inner rectangular box. To assemble the Lucky Dog Million Dollar Pattern Box, first start with FIG. 1,1C and FIG. 2,2L the numbered card front and back glued and applied back to back. Next lay numbered card front side up the apply FIG. 1,1E the front number screen. Then FIG. 1,1B and FIG. 1,1F the top front and bottom frame bar should be glued onto FIG. 1,1C. Then attach FIGS. 1,1F and 1,1G the front right and left inner rectangular side posts. Then form or build FIG. 1,1B, FIG. 1,1I, FIG. 1,1F, and FIG. 1,1G around the front of number card and screen. This will frame and build the front part of FIG. 1, the front of the inner rectangular box. Next turn the inner rectangular front over with the back facing up. Now apply the same steps in building the back of the inner rectangular box. Apply FIG. 2,2M, the back screen to FIG. 2,2L the back of the number card. Build FIG. 2,2K FIG. 2,2Q, FIG. 2,2N, and FIG. 2,2O around FIG. 2,2L back of the number card and FIG. 2,2M the back screen. This will build and frame the back of FIG. 2 back of the inner rectangular box. After this turn the inner rectangular box over front side up. To finish building the inner rectangular box, install the space bar FIG. 1,1H to block out any number(s) not to be played. Install the brass balls FIG. 1,1E with how many are needed which should be one ball.

Now the front transparent Plexiglas cover FIG. 5,5T should be installed over the number card, screen, space bar, and balls. This will protect the inner rectangular parts and balls from falling out. To finish the front of FIG. 1 the glow ball FIG. 1,1A needs to be installed in the left top front cover of the inner rectangular box. This completes the front of the inner rectangular box FIG. 1. Now turn the inner rectangular box to the back side to finish installing the components. First, install FIG. 2,2P the back space bar then the brass balls FIG. 2,2J. Afterwards install FIG. 5,5S the back Plexiglas cover. To complete the inner rectangular box install FIG. 5,5R and FIG. 5,5U. Now this completes the right and left side of the inner box. Now it's time to build the inner box protective case. First start by installing the left side FIG. 6,6W to FIG. 6,6X then FIG. 6,6Y to FIG. 6,6X. Now to complete the protective case install FIG. 6,6V to FIG. 6,6W and FIG. 6,6Y this now completes the protective cover case.

Figure 2:
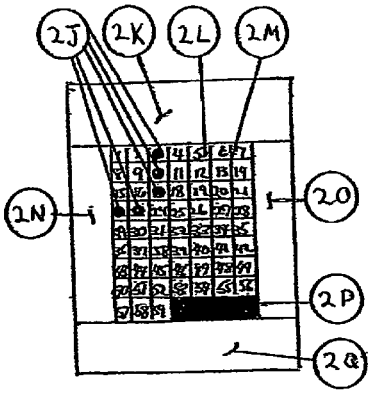

The operation of the Lucky Dog Million Dollar Pattern Buster can be best understood by referring to FIGS. 1 and 2 the inner rectangular box. The inner box while rotating around the laid on a flat surface is designed for the balls to roll in the spaces on the number card that denote numbers. These numbers where the brass balls land reflect numbers you would use to play in a lottery game is you wish.

The invention claimed is:

1. An apparatus for randomly picking lottery numbers comprising:

a hollow rectangular box having a front side and a back side; the front side of the hollow rectangular box having a front frame comprising a top front frame bar, a bottom front frame bar, a front right side post and a front left side post, the back side; the back side of the hollow rectangular box having a back frame comprising a top back frame bar, a bottom back frame bar, a back right side post and a back left side post;

a rectangular numbered pattern card having a front surface and a back surface, the front surface and back surface of said numbered pattern card each comprising a plurality of numbers in a grid pattern representing all the possible numbers of a lottery game, said rectangular number pattern card being located inside said hollow rectangular box between said front frame and said back frame;

a front thin sheer rectangular slotted wire screen forming a grid of open rectangular squares placed inside said hollow rectangular box between said front frame and said back frame lying on the front surface of said rectangular numbered pattern card forming square slots around each number of said plurality of numbers on the front surface of said rectangular numbered pattern card;

a back thin sheer rectangular slotted wire screen forming a grid of open rectangular squares placed inside said hollow rectangular box between said front frame and said back frame lying the back surface of said rectangular numbered pattern card forming square slots around each number of said plurality of numbers on the back surface of said rectangular numbered pattern card;

a front transparent Plexiglass cover installed over the front side of said hollow rectangular box enclosing the front side of the hollow rectangular box;

a back transparent Plexiglass cover installed over the back side of said hollow rectangular box enclosing the back side of the said hollow rectangular box;

a plurality of balls within the enclosed front side of the hollow rectangular box, and a plurality of balls within the enclosed back side of the hollow rectangular box, said plurality of balls freely movable with said enclosed front side and said enclosed back side when the hollow rectangular box is shaken, when the hollow rectangular box is laid on a flat surface with said front side face up, the plurality of balls in the enclosed front side roll on the front surface of said rectangular numbered pattern card and settle randomly in square slots corresponding with numbers of a lottery game, when the hollow rectangular box is laid on a flat surface with said back side face up, the plurality of balls in the enclosed back side roll on the back surface of said rectangular numbered pattern card and settle randomly in square slots corresponding with numbers of a lottery game.

2. The apparatus of claim 1, wherein said plurality of balls are brass balls.

* * * * *